US009526361B2

(12) United States Patent
Sellmeyer

(10) Patent No.: US 9,526,361 B2
(45) Date of Patent: Dec. 27, 2016

(54) PACKAGED INFLATABLE PILLOW FOR MULTIPLE USES FOR BODY SUPPORT AND WATER DEVICE ACCESSORY

(71) Applicant: Kurt S. Sellmeyer, Saint Louis, MO (US)

(72) Inventor: Kurt S. Sellmeyer, Saint Louis, MO (US)

(73) Assignee: The Pillow Plus, Inc., St. Louis, MO (US)

( * ) Notice: Subject to any disclaimer, the term of this patent is extended or adjusted under 35 U.S.C. 154(b) by 0 days.

(21) Appl. No.: 14/545,341

(22) Filed: Apr. 24, 2015

(65) Prior Publication Data

US 2015/0314844 A1 Nov. 5, 2015

Related U.S. Application Data

(60) Provisional application No. 61/996,208, filed on May 1, 2014.

(51) Int. Cl.

| | |
|---|---|
| ***A47G 9/10*** | (2006.01) |
| ***B63C 9/13*** | (2006.01) |
| ***B63C 9/30*** | (2006.01) |

(52) U.S. Cl.

CPC ..... *A47G 9/10* (2013.01); *A47G 9/1027* (2013.01); *B63C 9/13* (2013.01); *B63C 9/30* (2013.01)

(58) Field of Classification Search

CPC ..... B63C 9/05; B63C 9/13; B63C 9/18; B63C 9/30; A47G 9/10; A47G 9/1027; A47G 9/00; A47C 20/00

USPC ..... 441/125; 5/640, 644, 639, 645

See application file for complete search history.

(56) References Cited

U.S. PATENT DOCUMENTS

| | | | | |
|---|---|---|---|---|
| 4,175,297 | A | 11/1979 | Robbins et al. | |
| 4,345,347 | A | 8/1982 | Kantor | |
| 4,893,367 | A | 1/1990 | Heimreid et al. | |
| 5,503,456 | A | 4/1996 | Rossini | |
| 5,544,378 | A * | 8/1996 | Chow | A47C 7/383 5/644 |
| 5,584,086 | A * | 12/1996 | VanWinkle | A47G 9/10 5/644 |
| 5,802,643 | A | 9/1998 | Sloot | |
| 5,887,300 | A | 3/1999 | Pond | |
| 6,217,116 | B1 | 4/2001 | Sloot | |
| 6,519,796 | B2 | 2/2003 | Sloot | |
| 6,526,612 | B1 | 3/2003 | Zarrella | |
| 6,681,974 | B2 | 1/2004 | Rotter | |
| 6,748,615 | B1 * | 6/2004 | Tiedemann | A47C 7/383 5/644 |
| 6,910,237 | B2 | 6/2005 | DiGirolamo | |
| 6,934,989 | B2 | 8/2005 | Ledvina et al. | |

(Continued)

*Primary Examiner* — Lars A Olson

(74) *Attorney, Agent, or Firm* — Paul M. Denk

(57) ABSTRACT

A stretchable pillowcase with an inflatable pillow or bladder having an attached pouch that can be folded onto itself and enclose the pillow and cover therein during non-usage. But, the pillow and case can be removed from the pouch, the pillow inflated, to provide a cushion use of the pillow for comfort, and to use as a flotation device, for recreational purposes. The pillow is made of a water-proof and inflatable material, such as polymer and rubber, and the case may be formed of a resilient fabric material. Its pouch likewise, is fabricated from an expandable material, to allow it to fold onto itself, and enclose the pillow and case therein, once the former has been deflated.

7 Claims, 5 Drawing Sheets

(56) References Cited

U.S. PATENT DOCUMENTS

| | | | | |
|---|---|---|---|---|
| 6,957,914 | B2 | 10/2005 | Arends et al. | |
| 7,146,665 | B1 | 12/2006 | Moorin | |
| 7,223,462 | B2 | 5/2007 | Perkins et al. | |
| D558,596 | S | 1/2008 | Berman | |
| D597,854 | S | 8/2009 | Berman | |
| 8,458,834 | B1 * | 6/2013 | Brown | A47C 16/00 5/644 |
| 2008/0034504 | A1 * | 2/2008 | Schmidt | A47G 9/10 5/644 |
| 2014/0000036 | A1 * | 1/2014 | Cohen | A47C 7/383 5/639 |

* cited by examiner

PACKAGED INFLATABLE PILLOW FOR MULTIPLE USES FOR BODY SUPPORT AND WATER DEVICE ACCESSORY

CROSS REFERENCE TO RELATED APPLICATION

This non-provisional patent application claims priority to the provisional application having Ser. No. 61/996,208, filed on May 1, 2014.

FIELD OF THE INVENTION

This invention generally relates to the provision of body support, through use of a pillow that may be folded into its own case, and can be applied to various parts of the body, or to other devices, to provide for support, flotation, comfort, for use for home and recreational purposes, traveling, at the office, camping, or even at the beach.

BACKGROUND OF THE INVENTION

There are a myriad of variously designed pillows that have been available for eons, primarily for use for adding comfort to the user, and most specifically, for furnishing head support while resting or sleeping. Most medical professionals will agree that during periods of sleep or when sitting, reclining, partially horizontal or in a horizontal position, that proper head and neck support, back, knee and other support, is important in the prevention of back and neck pain that can lead to a condition which requires, eventually, some medical attention and treatment. Most people have adequate pillow supports in their homes, most commonly in the form of a pillow used while sleeping, or for application to a chair, bed or sofa, to add further comfort. When away from the home, such as during travel, vacation, camping, in the office, a pillow is a most common device for utilization as a temporary supporting means.

Many times a substitute will be made for the pillow, such as a wrapped up towel, or even wrapped up clothing such as shirts and jackets, as anyone familiar with camping has done while on a camping trip. But, these types of supports do not produce the results that are needed to furnish the optimum support that is required for the back, knee, head or neck support, under these conditions. Although many pillows may be known to have certain defects, for example, cotton fibers, the open-cell foam type, the memory foam type, and even in some instances feathers, do not provide the adequate support required, and may also be a haven, particularly on camping trips, as a habitat for mites, no-see-ums, and on the long term, particularly when they become wet, generate mold and mildew or other organisms. As stated, prior pillows can absorb moisture from the elements and they also tend to accumulate dirt, sand or other foreign objects which can be difficult to remove or to keep cleaned. Moisture and dirt, sand or other foreign objects, can cause mold to form in or on the pillow, which is very undesirable. Even if the pillow is removed, the moisture inside the pillow cannot be readily extracted and which can promote these types of deleterious growths.

There have also been pillows that include a self-contained pouch that opens on one or more ends, and allows for a securing device to be affixed for ease of carrying or attaching the pillow to another apparatus. Or, the pouch may be used as a case, or simply to allow the pillow to be rolled up or folded, and located in the pouch, for either self-contained or a combination invention, but most of these generally do not have the ability to get wet, nor dry quickly, nor can they be machine washable, because the innards of the pillows will absorb and retain moisture, and are very difficult to dry out.

Also, other types of pillowcases have been constructed that incorporate straps that affix to the case with a Velcro type of material, and for attachment of the case and its pillow to other apparatuses. Once again, it has not been seen where these types of pillows have been made of a water resilient fabric material, throughout its extent, that keeps it from getting wet. In addition, very few embodiments have incorporated fastening means that allow the pillow to be affixed around another device or apparatus, as a convenience during usage.

Additionally, prior pillows do not allow for the simple removal of a pillow for drying purposes, or general cleaning.

Examples of pillows incorporating a cover and further having a closure device, in the form of a pouch, can be seen in select prior patents. For example, the patent to DiGirolamo, U.S. Pat. No. 6,910,237 shows a pillow cover with closure and a pouch member therefor. This particular device shows a typical pillow, with a down filling, having a cover, and pouch combination, for use for at least positioning the cover inside the pouch during non-usage.

The patent to Rotter, U.S. Pat. No. 6,681,974 shows a fanny pack with an inflatable lumbar support. It further incorporates a belt arrangement, to allow the inflated pack to be worn around the waist of the user.

The patent to Moorin, U.S. Pat. No. 7,146,665 shows an inflatable disposable pillow with other comfort features. This appears to be a pillow that can circumvent the head and neck, during usage.

The design patent to Berman, U.S. Pat. No. D597,854 shows a zip sealed flexible pillow pouch.

The patent to Rossini, U.S. Pat. No. 5,503,456 shows a headrest, apparently of a cushioned type, that may incorporate stretchable straps, to allow the device to function as a headrest after it has been installed around the upper back portion of the shown lounge.

The patent Sloot, U.S. Pat. No. 5,802,643 shows a slip cover with an inflatable pillow that also may be applied to a lounge or a chair, to provide comfort for the back or head of the user, after the pillow has been inflated.

Another inflatable pillow is shown in the patent to Chow, U.S. Pat. No. 5,544,378. It also incorporates straps for application to a backrest.

U.S. Pat. No. 6,519,796, also to Sloot, shows a tote bag that incorporates a pillow. The tote bag can be used for that purpose, but can also be converted to an inflatable pillow, as can be noted.

The United States patent to Ledvina, et al, U.S. Pat. No. 6,934,989 shows another inflatable device.

A pillow pouch is shown in the United States patent to Berman, U.S. Pat. No. D558,596.

A hand-supported headrest pillow can be seen in the patent to Zarrella, U.S. Pat. No. 6,526,612.

A mat cover with self-encased pillow is shown in U.S. Pat. No. 5,887,300. This particular device appears to be either integrated into or attached to the upper end of a mat.

These are examples of known adaptations to pillows, for use as a headrest, body support, even inflatable ones, for use for a variety of purposes.

SUMMARY OF THE INVENTION

This invention contemplates the formation of a structured pillow, which will supply the need for a stretchable pillowcase incorporating an attached pouch that can be folded into itself, and thereby enclose the inflatable or other pillow to provide a very compact unit that is easy to carry, but can be unfolded, out of its pouch, inflated, and ready for application and usage including in water for a variety of purposes for supporting the head or other body parts during usage and application.

In usage, the concept of this invention is to provide an inflatable pillow that can be inflated for use for a variety of purposes, as previously reviewed, either for supporting the head, the back of the user, or even add support to the legs, and even can be used as a flotation device, for both recreational and emergency situations that may arise. In addition, the entire structured pillow can be of any size, but yet when it is deflated, can be folded up and arranged within a conveniently attached pouch, to facilitate its conveyance, such as while hiking, on a camping trip, or when proceeding to the beach.

Thus, the concept of this invention provides a comprehensive convenience as a solution to remedy body problems by providing benefits that are comprehensive in handling the variety of situations as just described. Thus, this invention helps to provide a solution to a variety of needs, and is not just a one use embodiment, as can be understood.

Clearly, a stretchable pillowcase with an attached pouch that can be folded into it, to enclose upon itself and the cover, in addition to the inflatable pillow, provides a benefit that is very useful and desired by many. Anyone that has taken an extended camping trip, where space or weight may be of a premium, or even during transit, such as airline travel, to a remote location for camping, or water recreation, requires that weight limits must be met, not exceeded, and the capacity of a variety of camping, fishing, and hunting equipment that must be applied to a backpack, when carried, must be seriously thought out. Hence, this current invention is one more example of how the comfort aspects of such a trip can be achieved, but the size reduced to a minimum, to attain the variety of results during usage of this pillow structure, when applied.

The structure of this current invention includes basically an inflatable pillow. It locates within a stretchable pillowcase. Attached to the pillowcase is a much smaller pouch, but which can accommodate the insertion of the deflated pillow, and its rolled up case, therein, due to the stretchability of the pouch, and therefore, minimize its size for conveyance purposes, as when not in use. But, when the inflated pillow is assembled for usage, and inflated into a size as desired, it can incorporate other accessories that allows for its application and usage in a variety of ways, to enhance its applicability. For example, there may be straps applied to either end of the pillowcase for the inflatable pillow. The straps may accommodate a variety of uses. For example, the straps may be applied around a chairback, in order to dispose the inflated pillow at the location of the user's head, to function as a headrest. Or, it may be lowered, to furnish a backrest, or even a pillow that can be used as a lumbar support, where that type of medical treatment is prescribed. The straps may be extendable, attachable, or simply have a variety of clasps that allow for fastening of the strapped pillow to the chair or body, as aforesaid. Or, the straps may be elastic, and can be stretched and held into position by means of a clasp, snaps, or even through the application of a hook and pile connecting means, known as Velcro. In addition, where the straps connect with the pillowcase, on either end, there may be a snapped loop opening, and through which, for example, a flotation noodle may insert through each loop, and thereby provide a head or chin rest, upon the flotation noodle, where it is used by the swimmer, when participating in this type of recreation.

The pouch may incorporate a series of reinforced button holes or grommets, and through which a carabineer may locate, in order to facilitate the carrying of the pouched pillow, as when not in usage. Or, the carabineer may even affix, for example, to the belt of the user, when being conveyed.

Obviously, to attain all of the features of this invention, when it is in usage, or when its pillow is deflated, and packaged along with its case within a pouch, the stretchability of the various components that make up this invention is essential. For example, the pouch needs to have some resiliency to it, in order to be stretchable, along with its pillowcase, in order for the pouch to be expanded, when it is reversed inside out upon itself, in order to accommodate the application of the stretchable pillow and/or its case, when it is deflated, folded up, and inserted and located within its accommodating pouch. The uniqueness of this invention, as can be understood, is that an inflatable pillow of any size, that can be used for a variety of purposes as explained, can be substantially reduced in size, once deflated and rolled up, and can locate within a much smaller appearing pouch, as during transit or storage.

Thus, the concept of this invention and its basic components, have been generally described herein, in explaining the structure of the packaged inflatable pillow for multiple uses for body support, and as a water device accessory, during application.

A few more points of information relating to the structure and application of the device of this invention may be analyzed as follows. For example, the pillow case itself may be made with a variety of fabrics and materials. These can be mixed or matched on various structured units, and the material may be selected from a Spandex, nylon, polyester, dazzel polyester, both of the stretch and no-stretch type, may be formed of denim material, cotton, polyfleece, elastic, nylon mesh, ripstop nylon, and related materials.

The various uses of this device can be as follows. It can be used as a wrist rest as when typing, it can provide various types of body supports as previously reviewed, as during sleep or rest, it can be applied under the head, neck, the back, between legs, under the ankle or foot or both, provide a back and stomach support, as during pregnancy. It can also be maintained in a small structure, as when carried on and prepared for usage upon the airplane, car, at sporting venues and events, during outdoor activities, such as camping or hiking, it can be used while hunting, as in a tree stand and blind, during its application.

This device, with its various accessories, and straps, can be attached to and used with a headrest, a lounge chair, both indoors and outdoors, with a beach lounge or chair, applied to a pool noodle, used in a hot tub, within a bathtub, upon a couch, a camping chair, at air ports, on the air plane, as aforesaid, in the car, and with other vehicles. The device can be attached to or used with other accessories while participating in water activities, such as upon a lounge chair, as aforesaid, on a beach chair, used as a beach pillow, connect to a pool noodle, applied to floating rafts or water floats, used like a saddle in the water, used while snorkeling, provide a floating pillow, and can be used as a pillow in a boat, or other flotation device, such as a kayak, during their application. The device can also be used with and applied for use for back or lumbar support and can be sat upon like a cushion, when applied, once again, to the lounge chair, beach chair, couch, office chair, kitchen or dining chairs, at the theater, restaurant, upon conference chairs, camping chairs, be used as a camping sleeping pillow, and again, at air ports, during the long wait. The device includes a storage pouch in which a cellphone, wallet, keys, credit cards, cash, headphones, iPads and iPods, and other small personal items may locate. It is a self-contained pouch that may hold many disposables, even such as a hand warmer, as can be recognized.

It is, therefore, an object of this invention to provide a stretchable pillowcase with an attached pouch that can be folded into itself, and to enclose upon itself and provide the cover for the inflatable or other pillow like structure when used.

It is still another object of this invention to provide a stretchable pillow that can be made waterproof, in order to resist the accumulation of water, dirt, sand or other foreign objects.

Another object of this invention is to provide a stretchable pillowcase with an attached pouch that can be folded into itself, and to enclose upon itself and provide a cover for a deflated pillow, that may also include the various accessories, such as non-corrosive eyelets, reinforced button holes, snaps, grommets, and the like, to avoid deterioration when the pillow is used, particularly under water exposure conditions.

It is another important object of this invention to provide a stretchable pillow and case with an attached pouch which is made of materials that retards any infestation of its components by mold, mildew, or other microorganism growth, and other insects like mites and no-see-urns.

It is still another object of this invention to provide a stretchable pillow and case with an attached pouch that is foldable, but readily removable from its self-contained pouch, in preparation for inflating, and usage, which pillow may inflate to a much more substantial and greater size than can be comprehended from the small expandable pouch that normally contains the same.

Still another object of this invention is to provide an inflatable pillow that can provide head, neck, back, knee or other body support for the user.

Another object of this invention is to provide a stretchable pillow with case and an attached pouch that can be inflated to various levels for multi-uses.

Still another object of this invention is to provide a stretchable pillow with case and an integrated pouch that incorporates various straps, on both sides and ends that allows for the inflated pillow to be adjusted and affixed to other apparatuses during usage.

Still another object of this invention is to provide a stretchable pillow and case with an attached pouch that can be made of stretchable water-resilient fabric, for additional flexibility and sizing that can be adjusted and affixed to other apparatuses, such as a lounge chair.

Yet another object of this invention is to provide a stretchable pillow with case and attached pouch that incorporates various accessories, such as snaps, reinforced button holes, grommets, and the like, that are non-corrosive.

Yet another object of this invention is to provide a stretchable pillow with case and attached pouch that can incorporate a variety of integral contours which extend the full length and width of the stretchable pillow and case.

Yet another object of this invention is to provide a stretchable pillow with case and attached pouch that can resist infestation.

Yet another object is to provide a stretchable pillow that is resistant to the accumulation of mildew, even after being used in a pool, at the ocean, hot tub, or lake, as a flotation item.

Still another object of this invention is to provide a stretchable pillow that is resistant to the accumulation of microorganisms.

Yet another object of this invention is to provide a stretchable pillow that is resistant to the accumulation of moisture.

Yet another object of this invention is to provide a stretchable pillow that is fabricated of fabrics that do not absorb moisture.

Yet another object of this invention is to provide a stretchable pillow and case with attached pouch that are fabricated of stretchable materials.

Still another object of this invention is to provide a stretchable pillow that deters infiltration by mites.

Yet another object of this invention is to provide a stretchable pillow with case and an attached pouch that is formed of a stretchable material, and which incorporates various non-corrosive reinforced button holes, eyelets, or grommets on its self-contained pouch in order to secure it closed for storage or transit.

Yet another object of this invention is to provide accessories for use with a stretchable pillow with case and attached pouch that will not rust or deteriorate.

Yet another object of this invention is to provide a stretchable pillow with case and attached pouch that may be linked with a carabineer, string, rope, belt, or other securing device, to facilitate its carrying or attaching to other apparatuses.

Another object of this invention is to provide a stretchable pillow with case and attached pouch that when the pillow is inflated, can be used for camping or hunting, as a camping pillow for comfort in tree stands or when sitting on the ground.

Still another object of this invention is to provide a stretchable pillow with case and attached pouch, that has multiple applications, such as for recreational purposes, and even for application as a flotation device.

Still another object of this invention is to provide a stretchable pillow with case and attached pouch that has multiple applications and functions, such as for use as a seat cushion, for sporting events, for other venues such as for use in kayaks, canoes, boats, on the ground as a comfort item, in the home, office, car, airplane, or for other applications where comfort is desired.

Still another object of this invention is to provide a stretchable pillow with case and attached pouch that can be used for medicinal purposes, such as a lumbar support, seat and back support while sitting in a chair, upon a lounge, sofa, or the like, where pillow softness is required to treat a medical condition.

Another object of this invention is to provide a stretchable pillow with case and an attached pouch that can be used as an ankle rest, a knee support, while in the partial or complete horizontal or prone position.

Another object of this invention is to provide a stretchable pillow with case and attached pouch that can be used as a wrist rest, such as while typing, using a keyboard, or when excessively using a mouse control while operating a computer.

Still another object of this invention is to provide a stretchable pillow with case and an attached pouch that can be applied to a swimming noodle, to function as a head or neck rest therewith, when applying the same in water.

Briefly, the stretchable pillow with case, and its attached pouch, of this invention, that can be folded into itself, can have various shapes, but the most common is of a rectangular design, which can be manufactured into a complete one piece stretchable pillowcase, for holding the inflated pillow, so that all of its various components, including its pouch, are integrated together, and cannot be separated, and therefore, prevents any misplacing, loss, or disposition of any of its components, during application, or thereafter. Its various accessories, such as the non-corrosive reinforced button holes, snaps, eyelets, or grommets, that are built into the structure of this device, will not rust or deteriorate, and are designed to create a path to release any water, air or other materials that may be collected therein, during various usage of this inflatable pillow. As noted, the stretchable pillow with case and its attached pouch can be folded into itself, and essentially encloses upon itself and functions as a cover for the inflatable or other pillow-like material, within its own self-contained pouch all formed of an elastic and stretchable material, especially around its opening in order to allow all of these components to become self-contained, when packaged within their pouch. The inflatable polyvinyl chloride (PVC) polymer, or other rubberized fabric or coated material of the like or mesh type can be used for the fabrication of the inflatable pillow, its stretchable or nylon case, as specifically as a stretchable or nylon elastic pouch. Preferably, the material used in the fabrication of these components will include polyester, Spandex, or other resilient fabric material. The outdoor camping or camouflage designed components include nylon material and other resilient fabric material used in the fabrication in the amount of 100% and a mesh accent on the side straps. These have been previously stated. Once the inflatable polymer and rubberized fabric or coated material forming the pillow has deflated, and inserted within its pouch, the position of the air valve for inflating or deflating it will also be encased within the integrated pouch. The attached pieces of the water resilient fabric material at both the side panels of the cover, which include the non-corrosive snaps to attach together with their various straps, can be affixed to a chair, lounge, seat, or the like. Also, the material used in the fabrication may be quick drying. The stretchable pillowcase includes additional stretchable, but water-resilient fabric that can be formed to various sizes, as desired and required for the circumstances. And, the straps, as applied to the pillowcase, can be used for a variety of purposes, such as forming loops for connecting onto a swimming noodle, or the straps themselves may extend around the back of a chair, to allow it to be held in place to function as a headrest or backrest, while the user relaxes. The device, as explained, can be folded up and inserted within its self-contained pouch, which has elasticity built into it, particularly around its opening, so that it can be folded upon itself, and encapsulate the deflated pillow and its cover therein, during non-usage. In addition, where this pillow can be used for outdoor camping, or perhaps even of camouflage design for use for hunting or military purposes, the fabric of the case, and even its pouch, can be made of a nylon and other resilient fabric materials, and/or mesh material. Only the pouch needs to be stretchable, particularly around its opening, as aforesaid.

These and other objects may occur to those skilled in the art upon review of the summary of the invention as provided herein, and upon undertaking a study of the description of its preferred embodiment.

DESCRIPTION OF THE PREFERRED EMBODIMENT

Figure 1:
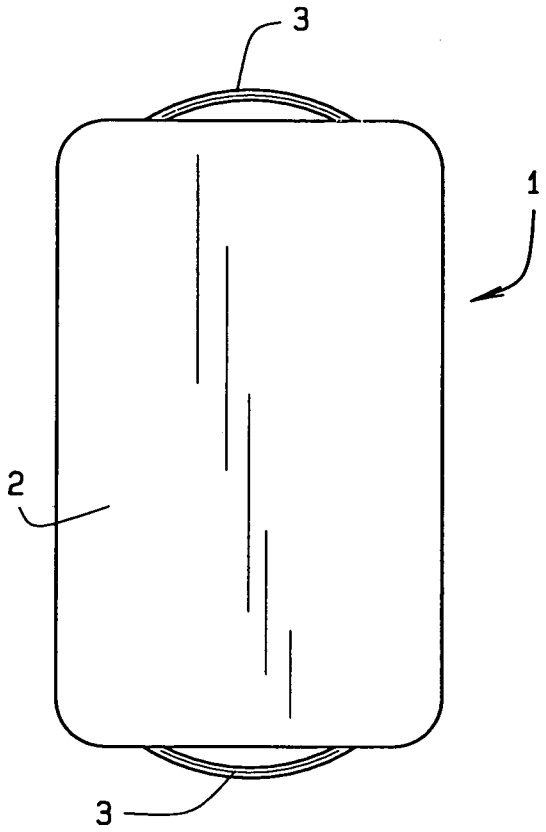
FIG. 1 is a plan view of the top of the inflatable pillow with case, and having loops provided at its ends, for attachment onto a flotation noodle.
Figure 1A:
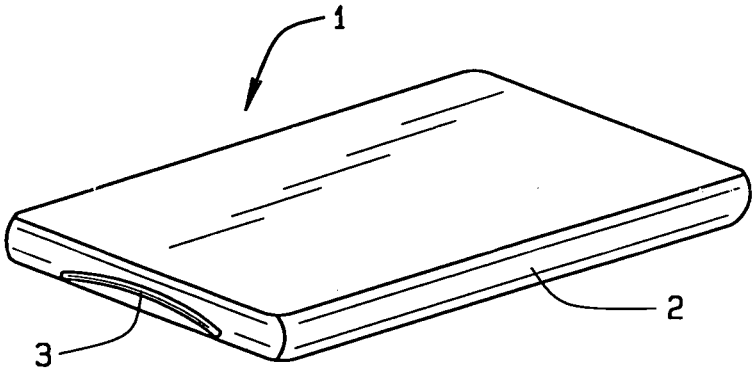
FIG. 1A provides an isometric view of the stretchable pillow as shown in FIG. 1.

In referring to the drawings, and in particular FIGS. 1 and 1A, therein is shown the stretchable pillow with case 1 of this invention. It includes its pillowcase 2, and has an inflatable pillow located within it (not shown) as can be understood. As previously explained, the stretchable pillow with its case, and the attached pouch, can be folded into itself, so as to enclose within its elastic pouch the deflated pillow, and its folded up case, as can be understood. The material from which the pillow and its case, in addition to the pouch, are generally water resilient fabric, which has stretchability, and yet can be machine-washed, with particularly the pouch being stretchable so as to contain the deflated pillow and its case, therein, as when not in usage. As previously explained, in the preferred embodiment, the fabric from which the cover and pouch are fabricated may be a polymer, such as polyester, stretchable Spandex, and other resilient fabric materials. Thus, the Spandex adds stretchability to the material, when formed into the case and pouch, to attain the purposes of the current invention. These materials generally are made of a water resilient fabric, particularly for the pillow itself, and its pillowcase. Or, the pillow itself may be fabricated of a pressurized air containing material, such as a rubber, or polymer, so that it may be inflated, as during usage, or deflated and rolled up, to be enclosed within its encasement pouch, all without losing its ability to maintain and hold pressurized air, when inflated for usage. The stretchable pillowcase is designed for functionality and comfort, with its ability to get wet and dry quickly, along with being machine-washable, when required, and to be able to stretch and retain its original shape, so it can be utilized for multiple uses.

FIGS. 1 and 1A also show the application of loops, as at 3, to each end of the case, so that these loops may be connected with some other structure, as when the device may be applied as a cushion onto a chair, or the loops may embrace more specifically, a flotation noodle, as previously explained, and for use within the pool, hot tub, bath, at the beach, or lake, as a flotation device. With the pillow applied, it adds comfort and is used as a headrest, or chinrest, when applied. Or, the noodle may be applied under the arms of the user, with the pillow against the chest, to add to the flotation of the device.

The inflatable pillow, and its stretchable pillowcase, can be used in any situation where a pillow, pillow cushion, a sit-a-upon cushion, a recreational water apparatus, head, neck and back lumbar support or wrist supporting device, may have applicability. Or the device may also have other recreational, office usage or application at outdoor events, as previously summarized. Obviously, the pillow may be available in different sizes, to meet the demands of the user, but in the preferred embodiment, the dimensions for a medium-sized version may be in the range of 10 inches in width, by 18 inches in length, with a larger version envisioned in the range of 14 inches in width, by 28 inches in length. Nevertheless, and regardless of its size, the expandable pouch will likewise be of a corresponding and comparable size, in order to accommodate the pillow and its case, when they are deflated and folded up for containment within the pouch, as during non-usage.

Figure 2A:
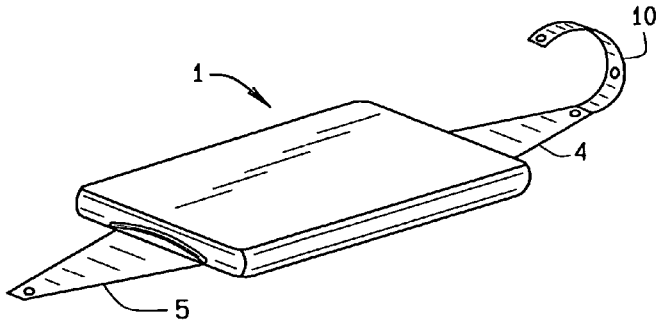
FIG. 2A is an isometric view of the stretchable pillow with case, and straps, as disclosed in FIG. 2.
Figure 2:
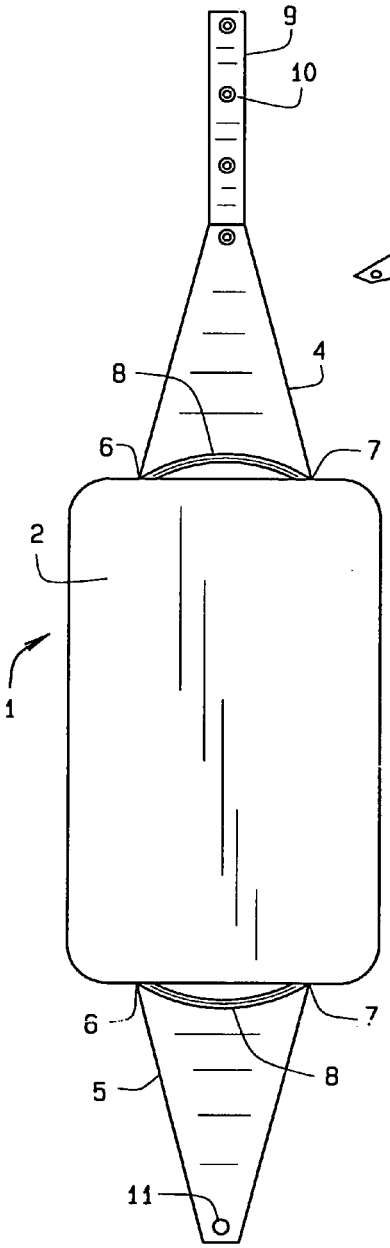
FIG. 2 is a plan view of the top side of the inflatable pillow with case, and having its extending straps connecting with each end of the shown structure.

FIGS. 2 and 2A disclose the inflatable pillow with pillowcase 1, as previously reviewed, but in this particular instance, extending from its ends are the extension straps 4 and 5. In their connection with case 2, the straps may be hooked at opposite ends, as can be seen at 6 and 7, so as to form open loops 8 through which one's arms may locate, or through which a flotation noodle may be applied, in the manner as previously explained.

Each of straps 4 and 5 extend away from the encased pillow 1, with the one strap 4 having a further extension 9 that incorporates a series of clasps or snaps, as at 10, and which can cooperate with snap 11 provided on the opposite strap, when the device may be secured around a person, or around the back of a chair, when it is in place. Strap 9 may have some elasticity to it, as may be straps 4 and 5, to allow for the device to be installed, with stretchability, to allow to be accommodated around various items, or a person, when installed for usage. Hook and pile fastening may also be used.

Figure 3:
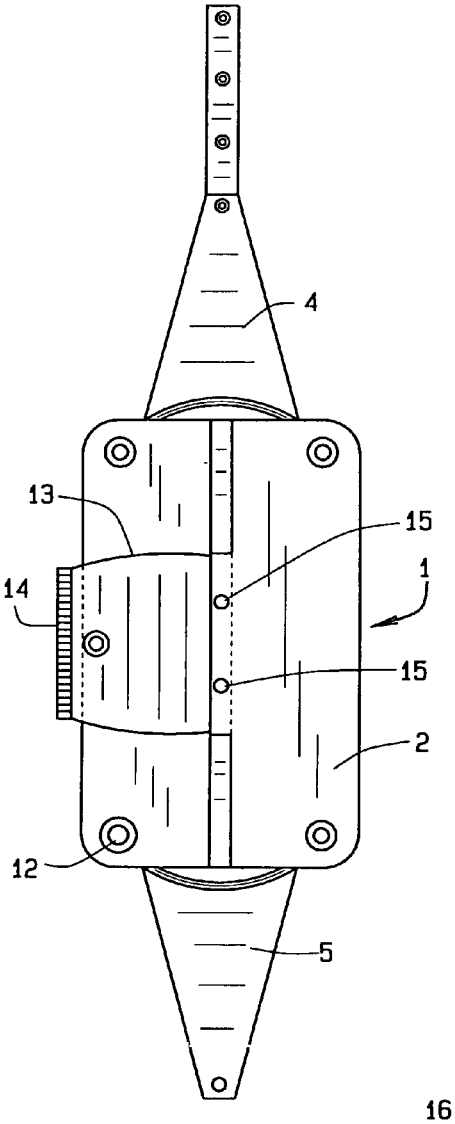
FIG. 3 is a plan view of the underside of the completely unfolded stretchable pillow with case, showing its attached pouch that can be folded unto itself to enclose upon itself and the cover for the inflatable pillow when not in usage.

FIG. 3 shows the underside, or backside, of the unfolded pillow and case 1 as previously reviewed, and shows the various valving, as at 12, which may be used for inflating its contained pillow, as can be understood. Or, when the valve is opened, the pillow may be deflated, after usage. But more particularly, therein is shown the application of the stretchable pouch 13 made of the expandable materials as previously described, and which may incorporate an elastic opening, as at 14, which allows the pouch to be expanded, so as to have the folded pillow and its case, including its straps, folded therein, as when the entire device is to be stored during non-usage. It can be seen that the pouch may be removably connected to case 2 by means of a pair of snaps, as at 15, so that it may be removable. Or, it can be permanently affixed thereto, as by stitching, or any other means for fastening.

It needs to be understood that the valve 12 connects to a bladder that locates within the case 2, to form the inflatable pillow therein, and that bladder may be formed of a inflatable polymer, such as polyethylene, polypropylene, and related polymer materials. The bladder for the pillow will extend throughout the interior of the case 2, as can be understood, and can be inflated, or deflated, through usage and application of the valving 12. As can be seen, the valve 12 extends through the various grommets, as explained.

Nevertheless, when the entire device is to be dismantled after usage, straps 4 and 5 will be folded to overlie the pillow and its case, the pillow and its case are further folded into a compact unit, and then pouch 13 can be stretched and folded into itself, including locating all of the folded components therein, so that all that evidently remains is just a ladened pouch, that stores these components for non-usage, or transit.

Figure 4:
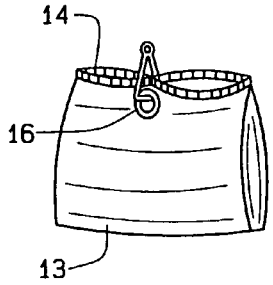
FIG. 4 is a perspective view of the pouch containing its deflated pillow and its case, providing a self-contained pouch for the entire development.

FIG. 4 shows the details of pouch 13, that contains the entire deflated pillow and pillowcase inside of it, due to its folding on itself, as can be understood. In addition, it can be seen that there may be a reinforced button hole or grommet, as at 16, provided along the upper elastic edge of the pouch, and the reinforced button hole or grommet may include a clip, or carabineer, as noted, to facilitate its clamping on the person, his/her belt, or to facilitate other carrying means, such as a shoulder strap, or the like.

Figure 4A:
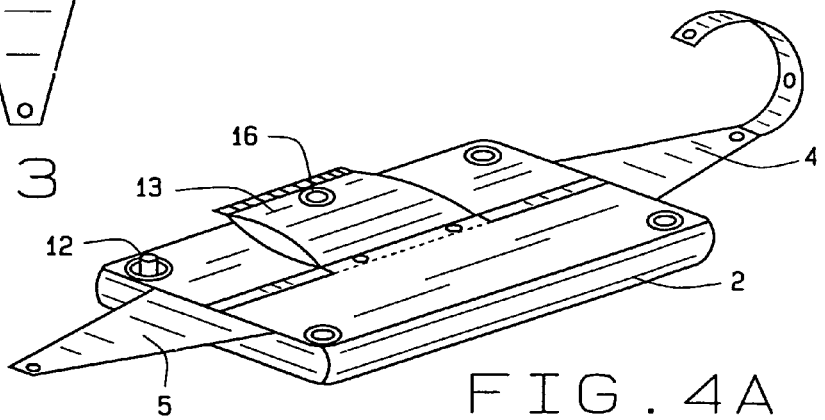
FIG. 4A is an isometric view of the underside of the stretchable pillow with case and showing its attached pouch integrated therewith.

FIG. 4A provides an isometric view of the device as noted in FIG. 3. The various components as just described are readily disclosed in this figure.

Figure 5:
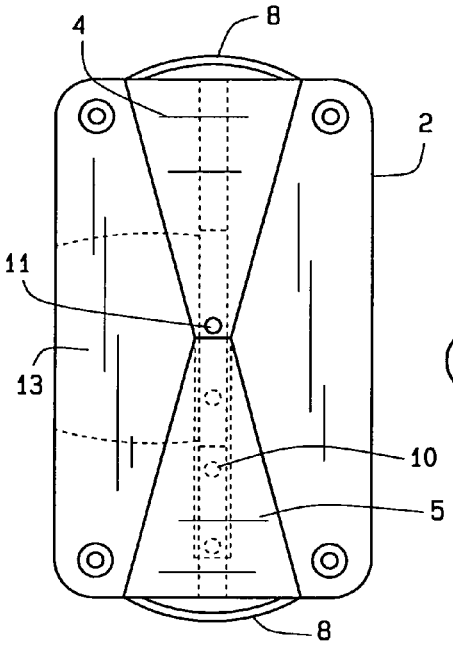
FIG. 5 is a plan view of the underside of the stretchable pillow with case, and its attached pouch, with its end straps being secured contiguously with the underside of the device.
Figure 5A:
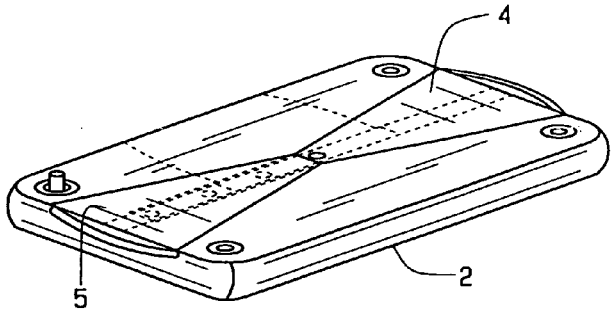
FIG. 5A is an isometric view of the underside of the stretchable pillow with case and attached pouch as shown in FIG. 5.

FIGS. 5 and 5A disclose the various components of the device as they are prepared for usage. As can be seen, the pillow or case 2 may have its straps 4 and 5 folded into contiguity with the underside of the said case, and snapped into a locked position, through its various snaps or clasps 10 and 11. In this position, as can also be noted in FIG. 5A, the various end loops 8 are readily available for connecting with a flotation noodle, as previously explained, or have the arms of the user located therethrough, when using the inflatable pillow as a personal flotation device. Loops 8 may have some elasticity and stretchability so as to allow them to expand, as the pillow is being applied.

Figure 6:
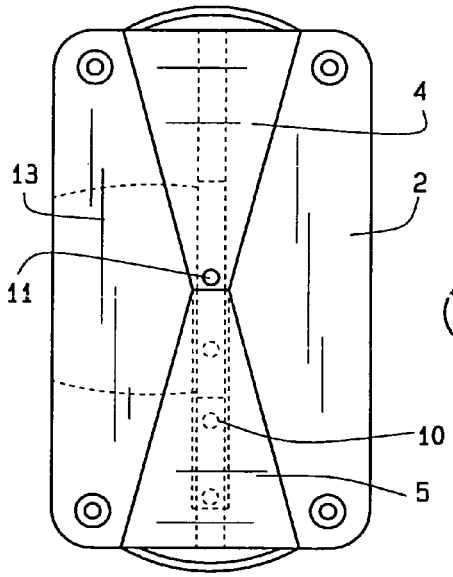
FIG. 6 is a plan view of the underside of the stretchable pillow with case and its attached pouch, and showing the loops provided at the ends of the device.
Figure 6A:
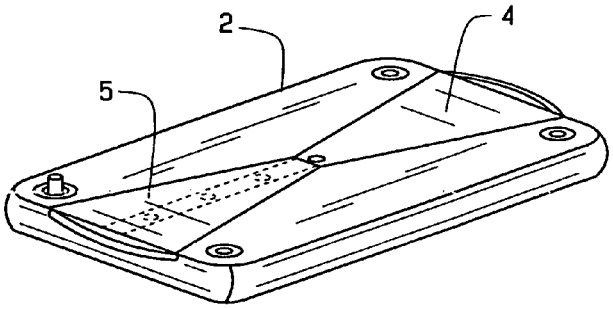
FIG. 6A is an isometric view of the device as shown in FIG. 6.

FIGS. 6 and 6A show similar views to those as previously explained. In this instance, the various non-corrosive snaps 10 and 11 are further disclosed, to show how the straps may be folded adjacently to the undersurface of the pillow, when the straps are not to be used. Or, the entire unit may be in this position just before the pillow and its case are folded into closure, in preparation for locating within pouch 13, as previously explained. The fully attached self-contained pouch 13 with its means to stretch at least at its opening 14 does have the ability to stretch and secure the entire apparatus, including its pillow, cover, and straps, that may be folded into themselves, and then the pouch is turned inside out, with all of these prior folded components locating therein, to undertake the position as shown for the pouch noted in FIG. 4. FIGS. 5 and 5A indicate that the self-contained pouch, when not in use, may be tucked inside the stretchable case or pillowcase, when the embodiment as shown in these figures is ready for usage as a flotation device, or a cushioning means.

As previously reviewed, all of the metalware that may be included within the structure of this device, including the reinforced button hole, eyelets, and grommets, in addition to the snaps and clasps, are all made of non-corrosive metal, in order to prevent their rusting. And, they are designed to release water, or other foreign material, that may otherwise collect inside, during their various uses.

Figure 7:
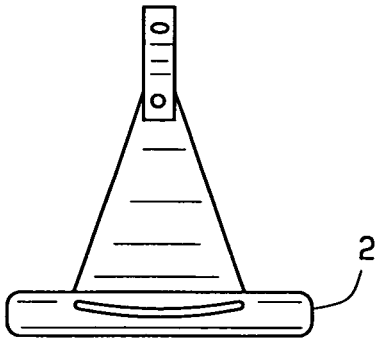
FIG. 7 is an end view of the inflated pillow, and showing how its extension straps can be looped and connected together, as when applied around the user, or, for example, around the back of a lounge.
Figure 7A:
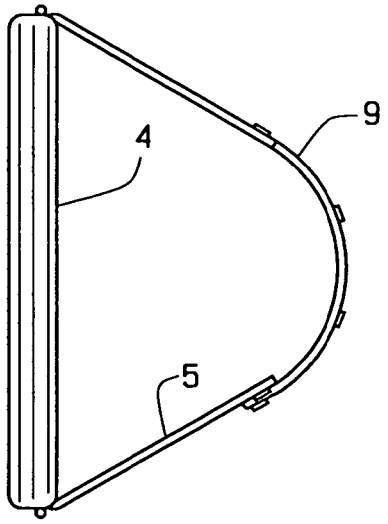
FIG. 7A is a side view of the device as shown in FIG. 7.

A further alternative in the usage of this invention can be seen in FIGS. 7 and 7A. As noted, the inflatable pillow and its cover 2 are shown with their straps 4 and 5 into an expansive loop, in order to allow the straps to surround an object, whether it is a person, or to loop around the back of a chair, as can be understood. Since the various snaps are arranged on strap 4, through its extension 9, the straps may be adjusted to that dimension that provides for a snug fit of the pillow, during usage, whether it is applied to a person, or structure.

Figure 8:
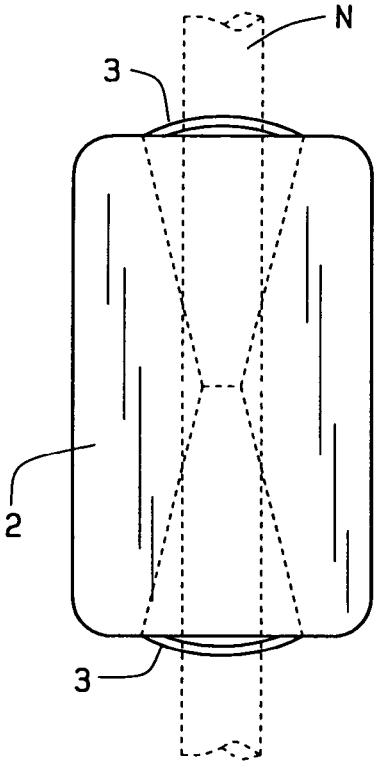
FIG. 8 is a top view of the stretchable pillow with case and showing how its loops connect onto a noodle during usage of this device while swimming at the beach, pool, or other body of water such as a hot tub or bath.
Figure 9:
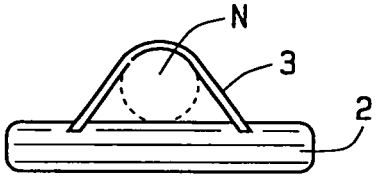
FIG. 9 provides an end view of the pillow of FIG. 8 showing its attachment to a foam swim noodle.
Figure 10:
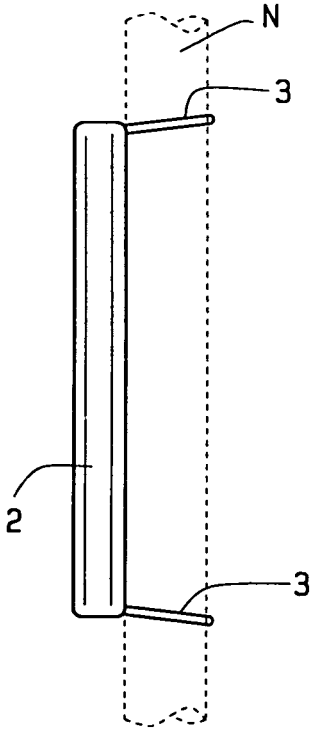
FIG. 10 is a side view of the inflated pillow of FIGS. 8 and 9, showing the attachment of its loops onto the foam swim noodle during usage.

In addition, FIGS. 8-10 are similar to that as previously explained with respect to claims 1 and 1A. As noted, loops 3 are disposed for having a foam swim noodle, as at end, applied therethrough. In this manner, the inflatable pillow then is readily disposed for functioning as a headrest, or armrest, as a flotation means for use within a swimming pool, ocean, or lake, as it is applied.

Notwithstanding, after all of these uses, the pillow can be deflated, within its case, if one is used, the various straps can be folded in contiguity with the pillowcase, and then can be rolled up into a smaller configuration, with the pouch being stretched, and turned inside out, in order to locate all of these folded components within the pouch, for storage or transit, as can be readily understood.

To summarize the various uses for this unique invention, it can be readily understood that the pillow can obviously be used as a headrest. It further has applicability as a back support, such as prescribed by a physician, for lumbar support, or simply on a sofa while reading or watching television. It can also be applied around an office chair, to provide back support, during long hours of work. It can further be applied, on a smaller scale, as a wrist rest, for relaxing the arms during the long, typical work days at the keyboard. It can be used in the classroom as a back support, as well as to sit on to add comfort. The device can be used on the beach as a head and backrest, or in the water, fully inflated, to add fun, operate as a colorful float, or function as a head, arm, or chest flotation device. Or, it can be used in conjunction with a flotation noodle, to add to its utility. In addition, the various loops at the end of the pillow can have the arms applied therethrough, for functioning as a flotation device. It can be used for traveling as a headrest, or as a camping sleep pillow, or an outdoor comfort and supporting device. It can also be applied at sporting events, to allow one to sit on it rather than those cold, hard and numbing bleachers. It can further have therapeutic effect as a knee and ankle support, as can be understood. These are all the voluminous uses that can be made of the device of this invention. Notwithstanding, these myriad of applications, the entire device can be deflated, rolled and folded up, and its appended pouch simply turned inside out after stretching, to encompass all of these components therein, to provide a very small, compact holder for facilitating the conveyance or storage of the pillow, during non-usage.

Variations or modifications of the subject matter of this invention may occur to those skilled in the art upon review of the invention as described herein. Such variations, if within the spirit of this invention, are intended to be encompassed within the scope of any claims to patent protection issuing hereon. The description of the invention in the preferred embodiment, and its depiction in the drawings, are primarily set forth for illustrative purposes only.

I claim:

1. A versatile inflatable pillow for use for body support and as a water flotation device, comprising:

an inflatable pillow for application to one of a user or structure, said inflatable pillow formed as a bladder and enclosed within a foldable pillowcase, said pillowcase having a top-side and an underside, the underside of said pillowcase having a central portion;

a pouch, said pouch being formed of a stretchable fabric and capable of expanding to enclose the folded and deflated bladder and pillowcase therein during non-usage, said pouch having an elastic opening formed at its upper edge, and said pouch at its bottom edge being attached to the central portion of the underside of said pillow case;

said pouch capable of being folded inside-out to locate the deflated pillow and pillowcase as folded therein during storage or transit;

said pillowcase having upper and lower ends, and a loop provided at each of the upper and lower ends of said pillow case and provided for attachment to other structure during usage; and extension straps connecting with the loops at the upper and lower ends of said pillowcase and capable of adjustably being applied to a person or a structure during usage of the inflatable pillow for the comfort of its user.

2. An inflatable pillow and stretchable pillowcase with attached pouch of claim 1, including said pair of loops, one of each loop being connected to the ends of the pillowcase, for accommodating the gripping of a flotation noodle or a user during usage of the inflatable pillow as a flotation device.

3. An inflatable pillow and stretchable case with an attached pouch of claim 1, wherein said extension straps include a series of clasps to allow for the adjustable connection of the pillow to the user or structure during application.

4. The inflatable pillow with stretchable pillowcase with attached pouch of claim 3, wherein said clasps are non-corrosive.

5. An inflatable pillow with stretchable pillowcase and attached pouch of claim 1, wherein said pillow includes an inflatable air valve, for use for inflating or deflating of said inflatable pillow during its application and usage.

6. A deflatable pillow and stretchable pillowcase with attached pouch as defined in claim 1, wherein said pouch containing the folded pillow and pillowcase can cooperate with securing means that facilitates the carrying or attachment of the device to another apparatus.

7. The inflatable pillow and stretchable pillowcase of claim 1, wherein said pillow being formed of an air inflatable and water-resistant, one of polymer and rubber, and said pillowcase being formed of a water-resilient fabric material, and said pouch being formed of a stretchable fabric capable of expanding to enclose the folded and deflated pillow and its pillowcase therein during non-usage.

* * * * *